US009027569B2

(12) United States Patent
Chung et al.

(10) Patent No.: US 9,027,569 B2
(45) Date of Patent: May 12, 2015

(54) DEVICE AND METHOD FOR INTERTWINING A MATERIAL ACCORDING TO A SELECTED PATTERN

(75) Inventors: Caleb Chung, Boise, ID (US); Robert M. Sesek, Boise, ID (US)

(73) Assignee: Giving Toys, Inc., Boise, ID (US)

( * ) Notice: Subject to any disclaimer, the term of this patent is extended or adjusted under 35 U.S.C. 154(b) by 0 days.

(21) Appl. No.: 13/586,744

(22) Filed: Aug. 15, 2012

(65) Prior Publication Data

US 2014/0048091 A1 Feb. 20, 2014

(51) Int. Cl.
*D04C 3/00* (2006.01)
*A45D 2/00* (2006.01)

(52) U.S. Cl.
CPC .. *D04C 3/00* (2013.01); *A45D 2/00* (2013.01); *A45D 2002/005* (2013.01)

(58) Field of Classification Search
CPC ..... A45D 2002/005; A45D 2002/006; A45D 2/00
USPC ..... 132/212, 200; 87/14, 20; 57/264
See application file for complete search history.

(56) References Cited

U.S. PATENT DOCUMENTS

| | | | | | |
|---|---|---|---|---|---|
| 3,685,271 | A * | 8/1972 | Wall et al. | 57/68 |
| 3,986,330 | A * | 10/1976 | Kuttruff et al. | 57/94 |
| 4,369,690 | A * | 1/1983 | Sapkus | 87/33 |
| 4,583,561 | A | 4/1986 | Larsson | |
| 5,682,146 | A * | 10/1997 | Neumann | 340/677 |
| 5,834,040 | A | 11/1998 | Israel et al. | |
| 5,988,181 | A | 11/1999 | Gable et al. | |
| 6,164,289 | A | 12/2000 | Ogunro et al. | |
| 6,439,096 | B1 | 8/2002 | Mungalov et al. | |
| 6,499,491 | B2 * | 12/2002 | Kennedy et al. | 132/212 |
| 6,575,175 | B2 | 6/2003 | Kim et al. | |
| 6,637,441 | B2 * | 10/2003 | Kennedy et al. | 132/212 |
| 6,802,830 | B1 * | 10/2004 | Waters et al. | 604/289 |
| 6,856,851 | B2 * | 2/2005 | Baitelli et al. | 700/142 |
| 7,069,635 | B2 | 7/2006 | Van Lenthe et al. | |
| 7,069,935 | B2 | 7/2006 | Bousfield et al. | |
| 7,513,021 | B1 * | 4/2009 | Haselwander | 28/248 |
| 7,905,237 | B2 | 3/2011 | Noh | |
| 8,261,648 | B1 * | 9/2012 | Marchand et al. | 87/34 |
| 2005/0039769 | A1 | 2/2005 | Bousfield et al. | |
| 2009/0283107 | A1 * | 11/2009 | Noh | 132/212 |
| 2009/0283108 | A1 * | 11/2009 | Brouillard | 132/212 |

FOREIGN PATENT DOCUMENTS

| | | | | |
|---|---|---|---|---|
| DE | 19914878 C2 * | 4/2003 | | A45D 8/34 |

OTHER PUBLICATIONS

US Patent and Trademark Office; Office Action for U.S. Appl. No. 13/586,726 dtd Jan. 2, 2014.
International Searching Authority; ISR & WO for US Serial No. PCT/US2013055182, dtd Jan. 17, 2014.

* cited by examiner

*Primary Examiner* — Robyn Doan
*Assistant Examiner* — Tatiana Nobrega
(74) *Attorney, Agent, or Firm* — Parsons Behle & Latimer

(57) ABSTRACT

A device and method for braiding hair or other flexible filaments is disclosed herein. The device comprises controller and a motor whereby the device may be used to intertwine strands of the flexible filament in a desired pattern. A user interface that allows the user to select a variety of pattern modules for operating the device.

23 Claims, 9 Drawing Sheets

DEVICE AND METHOD FOR INTERTWINING A MATERIAL ACCORDING TO A SELECTED PATTERN

FIELD

The present disclosure relates to device and method for intertwining flexible strands of a material, and more particularly relates to a device and method for braiding hair in multiple configurations.

BACKGROUND

Braiding is widely recognized as a form of hairstyling, and is commonly used to form ropes and other objects. Numerous devices have been developed to assist in braiding or intertwining hair and other materials. These devices are often directed to braiding hair in a flat, three-strand pattern. For example, U.S. Pat. No. 4,369,690 discloses a hand held, hand operated device with a set of three elliptical gears, through which the user places his or her hair. By using a rack and pinion connected to a hand crank, two sector gears move the elliptical gears in an alternating pattern, thus forming the braid. Other hair-braiding devices, such as disclosed in U.S. Pat. No. 5,988,181, use motors or actuators to move strands about in a set pattern to result in a three-strand braid.

Existing hair braiding devices, however, exhibit several drawbacks, including disorderly braids, inconsistent performance, and/or difficult operation. Further, the existing devices are limited to repeating a single braiding pattern using three strands.

SUMMARY

The present disclosure provides a device and method for intertwining a filament, or other flexible material in a variety of patterns. In particular, the device comprises a housing, which contains sector gears and elliptical gears, at least one motor, and a controller for controlling the motor. The hand-held braiding device may also comprise a memory unit and a user interface for selecting and storing different braiding patterns.

Another aspect of the present disclosure provides a method for selecting a pattern module for weaving strands. The pattern module may be selected using the user interface of the hand-held braiding device described above. This pattern module may be stored in the memory unit of the device or in a readable media device. The pattern module is loaded into the controller, for example, using the user interface, and the device is operated using an actuator.

Other systems, methods, features, and advantages of the present disclosure will be or become apparent to one with skill in the art upon examination of the following drawings and detailed description. The features, functions and advantages that have been discussed can be achieved independently in various embodiments of the present invention or may be combined in yet other embodiments further details of which can be seen with reference to the following description and drawings.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

In the following description, reference is made to the accompanying drawings, which form a part hereof, and in which is shown, by way of illustration, various embodiments of the present disclosure. It is understood that other embodiments may be utilized and changes may be made without departing from the scope of the present invention.

Figure 1:
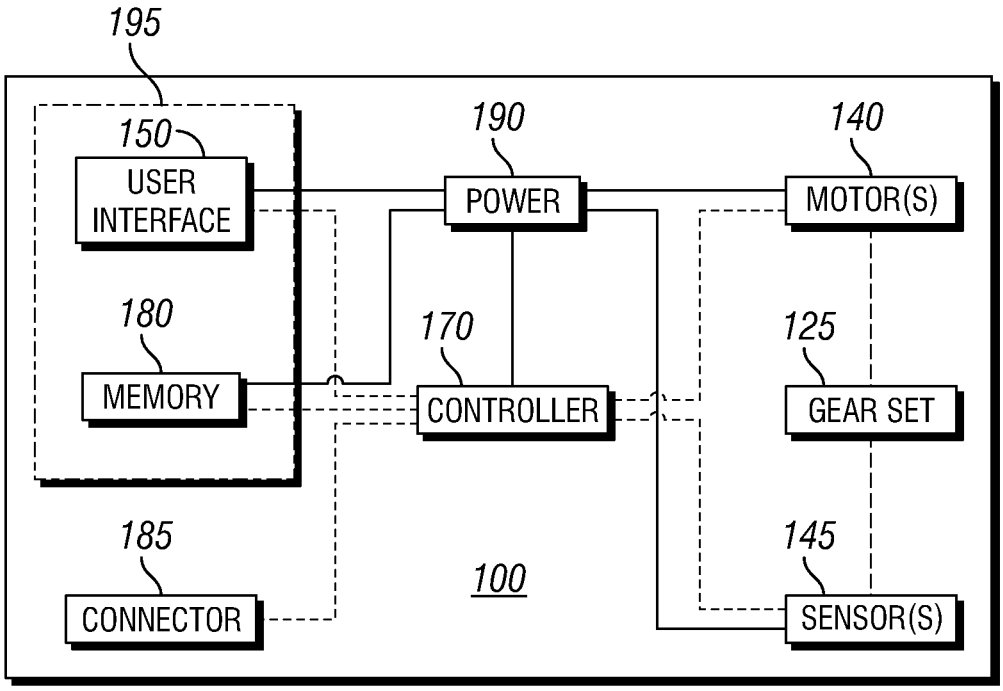
FIG. 1 is a schematic illustrating the relationship of the various features according to one embodiment of the present disclosure.

FIG. 1 illustrates one embodiment of the present disclosure, wherein the various features of the device 100 are represented schematically. In this figure, the features of the device are not represented to scale, but are arranged for convenience in explaining the device. The solid lines between the elements represent the electrical connections from power source 190. The dotted lines represent data or command connections between the various elements and a controller 170. The dashed lines represent the physical connections between the gear set 125 and the at least one motor 140, and between the gear set and the at least one sensor 145. The gear set, which may comprise a conventional set of toothed gears or other strategically shaped items, is driven by at least one motor 140, which is controlled by the controller 170. A plurality of sensors 145 monitor the movement of the gear set 125 and provide data to the controller 170, which is used in the execution of a set of instructions. The instructions are provided to the controller through the memory unit 180 by using a user interface 150. The sectioned line 195 is drawn around the memory unit 180 and the user interface 150 to show that these two features in particular may be separate from the physical hand-held device.

Figure 2A:
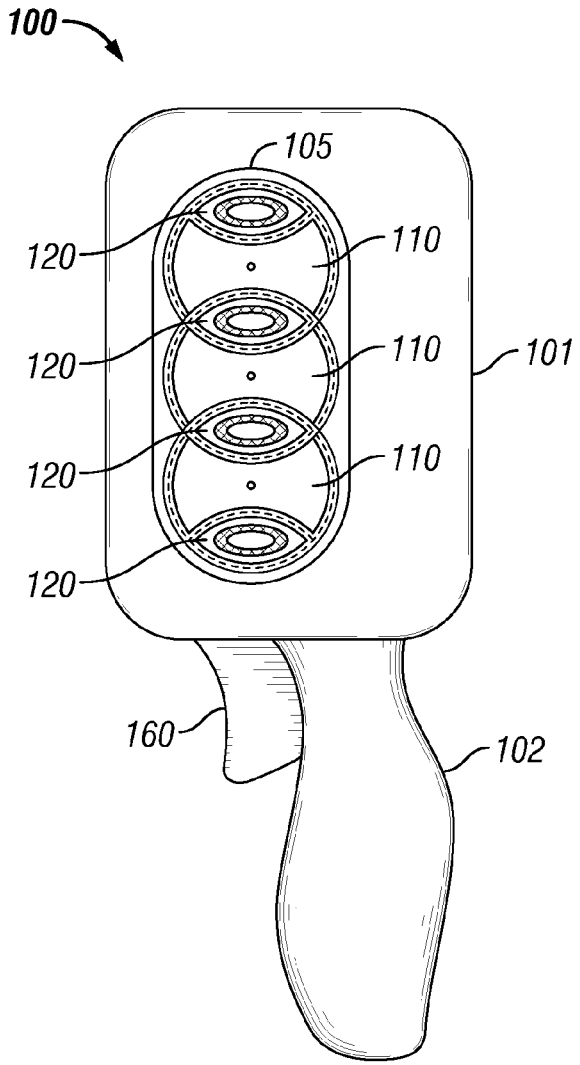
FIG. 2A is a top view one embodiment of a hair-braiding device in accordance with the present disclosure.
Figure 2B:
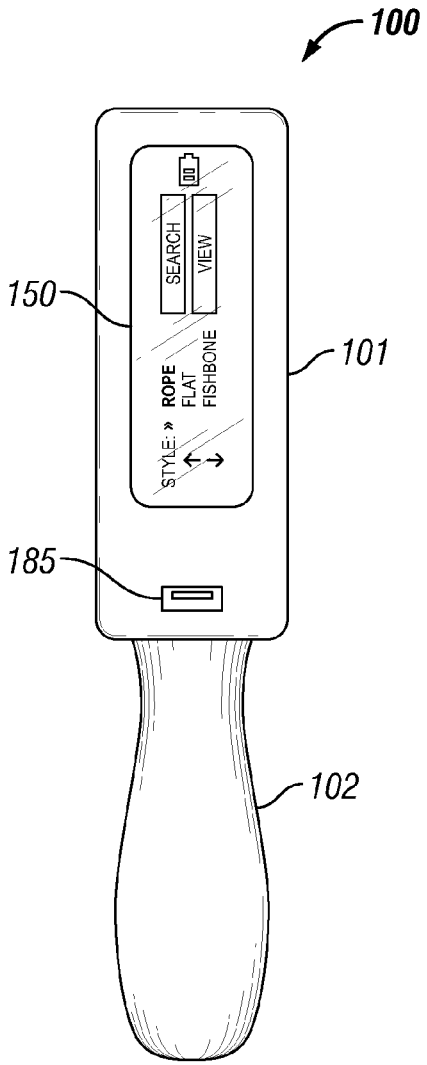
FIG. 2B is a side view of the device shown in FIG. 2A.
Figure 2C:
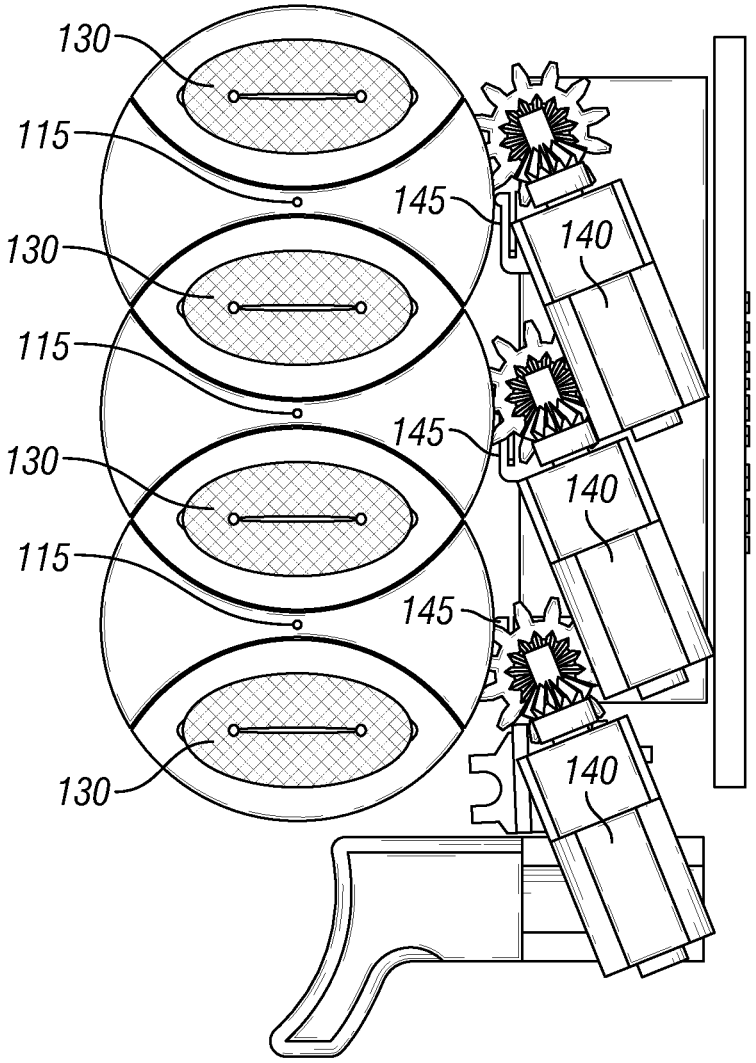
FIG. 2C is a partial top view, (without the housing), of the device shown in FIG. 2A.

FIGS. 2A and 2C illustrate another embodiment of a device 100 according to the present disclosure. The hair-braiding device 100 comprises a housing 101 with a handle 102 attached thereto. The hair-braiding device 100 also comprises three sector gears 110 and four elliptical gears 120. The sector gears 110 and the elliptical gears 120 are arranged in the housing 101 and are accessible at each of the top and bottom sides of the housing 101 through an opening 105. Each of the elliptical gears 120 is hollow and contains a respective sleeve 130. The various gears are turned by the motors 140, each of which is shown connecting to one of the sector gears 110. Each of the sector gears 110 rotates about a corresponding pivot 115. The illustrated embodiment also shows three sensors 145, each of which is paired with a respective motor 140. The hair-braiding device also comprises an actuator 160.

FIG. 2B illustrates another embodiment of a hair-braiding device 100 in accordance with the present disclosure, comprising a housing 101 and a handle 102. A user interface 150 is visible on the side of the housing 101. Connector 185 is also visible on the side of the hair-braiding device 100.

In some embodiments, the housing 101 of the hair-braiding device 100 is comprised of two pieces, an upper housing and a lower housing, which fit together to form the housing 101 having a cavity therein to contain many of the elements of the hair-braiding device 100. Alternatively, the housing 101 may comprise a unitary structure, wherein, for example, the housing comprised two halves that are brought together using a thermoplastic weld. The opening 105 of the housing allows access to the moving parts of the hair-braiding device 100, namely, The material of the housing structure may be comprised of any suitable material, including plastics, metals, and any other material commonly used in the manufacture of household beauty products. The opening 105 may be provided on the top and the bottom of the housing 101, thereby allowing the user to access the gears from either side. Further, the housing 101 may be provided with a protective or decorative cover, which may be used for aesthetic purposes or to cover seams or other parts of the housing 101 in which hair may potentially become caught.

In various embodiments, the handle 102 may be formed with the housing 101 or as a separate element which is attached to the housing 101 at a later time. In some embodiments, the shape of the handle 102 comprises an ergonomic shape. The handle 102 may also comprise an outer surface formed of foam or another suitable substance for creating a comfortable grip, as may be found commonly in the art.

In the embodiment shown in FIGS. 2A and 2C, three sector gears 110 and four elliptical gears 120 are visible through the opening 105 in the housing 101. The sector gears 110 are in a shape similar to the profile of a symmetrical apple core in appearance and the elliptical gears are in the approximate shape of an ellipse with two pointed ends. The shape of the sector gears 110 and elliptical gears 120 are complementary, such that by adding the pointed "elliptical" shape of an elliptical gear to each side of the sector gears 110, the objects collectively take the approximate shape of a circle. By arranging the gears in an alternating fashion (elliptical, sector, elliptical, sector, etc.), with the center of each gear forming a straight line, (in a vertical direction looking at FIG. 2A or 2C), the gear arrangement takes the shape of a series of intersecting circles. See also FIG. 3A.

The motions of the gears rotate about each of the three pivots 115. Each of the sector gears 110 corresponds to one of the pivots 115, which is located at the center of each of the sector gears 110. In some embodiments the pivot 115 may comprise a pin or other physical feature at the center of the sector gears 110. Alternatively, the pivots 115 may be formed integral to the sector gears 110. In other embodiments, a pivot 115 is merely defined as the location about which the rotation takes place, wherein the motion of the gears is guided, for example, by outer constraints on the movement of the gears, such as a channel defining the outer bounds of the gear set 125.

Figure 3A:
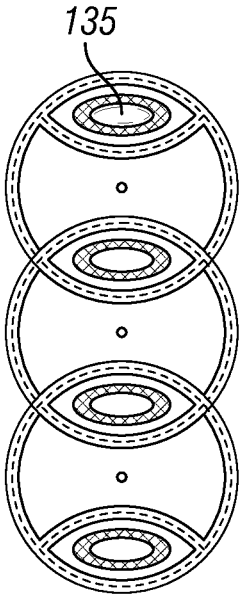
FIGS. 3A-3D are illustrations depicting the motion of the gears of a hair-braiding device in accordance with the present disclosure.
Figure 3B:
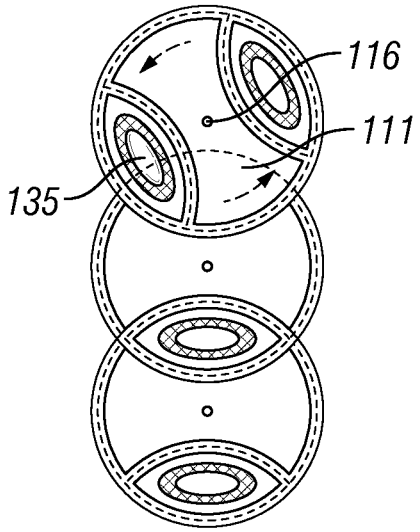
Figure 3C:
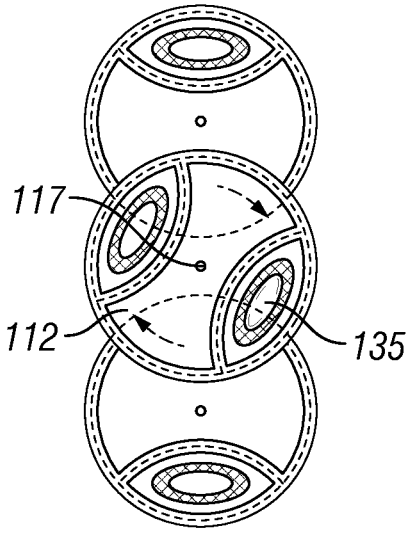
Figure 3D:
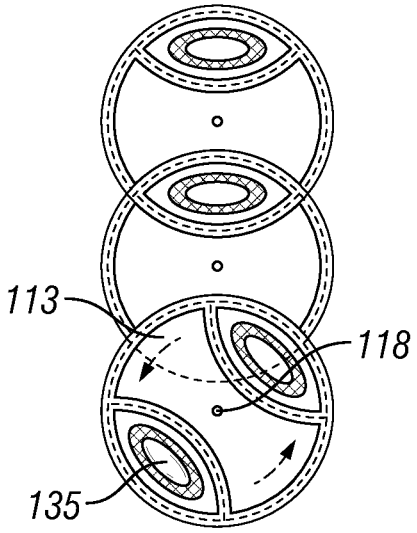

The elliptical gears 120 also rotate about one of the pivots 115, but may rotate about any one of the pivots, depending on the relative position of the elliptical gear. The elliptical gears 120 also rotate about one of the pivots 115, but may rotate about any one of the pivots, depending on the relative position of the elliptical gear. For example, FIGS. 3A-3D demonstrate the relative motion of the gears wherein the gears are rotated about one of the pivots 115 at a time, wherein the arrows show the direction of rotation. FIG. 3A shows the gears in a default position, wherein the gear arrangement takes the shape of a set of intersecting circles, as explained above. FIG. 3B shows a first motion of the gears wherein sector gear 111 is rotated about pivot 116; FIG. 3C shows a second motion wherein sector gear 112 is rotated about pivot 117; and FIG. 3D shows a third motion wherein sector gear 113 is rotated about pivot 118. In some embodiments sector gears 111 and 113 may be rotated simultaneously. By performing these motions in the desired order, the relative position of elliptical gears 120 may be changed. Note, for example, open space 135 (shaded), which changes position through each of FIGS. 3A-3D, as these motions are performed in succession. In some embodiments, the sector gears 110 may be rotated in either direction about the corresponding pivot 115.

Figure 3E:
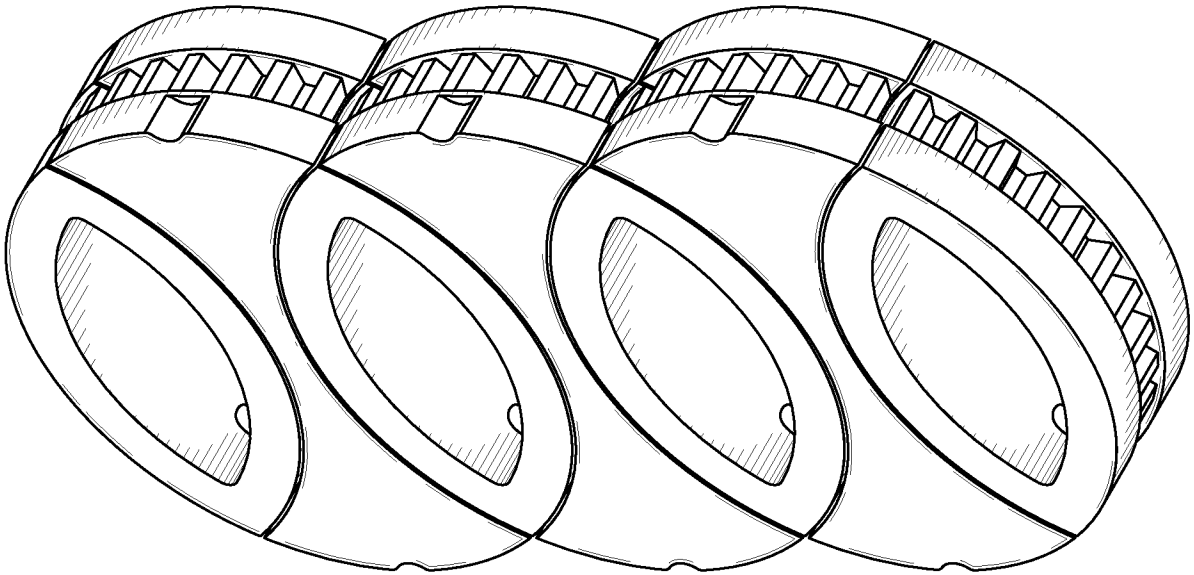

In the embodiment illustrated in FIG. 2C, the motion of the sector gears 110 and elliptical gears 120 is manipulated by three separate motors 140. As shown in FIG. 2C, the motors 140 may be in contact with the sector gears when the gears are in the default position (FIG. 3A). The outlying portions of the sector gears 110 and the perimeter of each of the elliptical gears may include a plurality of teeth. These teeth may then be manipulated by one or more of the motors 140, which may be a worm drive or similar actuator to rotate the gears about any one of the pivots 115 as desired. The teeth of the sector gears 110 of one embodiment of a gear set 125 are visible in FIG. 3E.

Other motors and arrangements of motors relative to the gears are further contemplated by this disclosure, as may be apparent to one of ordinary skill in the art. For example, in some embodiments, the motors 140 may be rotary in nature and connected to one of the pivots 115, either directly or by some other mechanical device such as a drive belt, thereby turning the respective gears. In this alternative example, the sector gears 110 and elliptical gears 120 may be toothless. In this respect, the use of the term "gear" within the present disclosure may be construed to include a plurality of moving parts which may result in a similar motion.

In one alternative embodiment, the device 100 of the present disclosure may comprise one motor 140 which provides power to drive each of the sector gears independently. This alternative arrangement may be achieved using, for example, a clutch for each of the rotating sector gears, wherein the controller operates the engagement of each clutch.

Figure 4A:
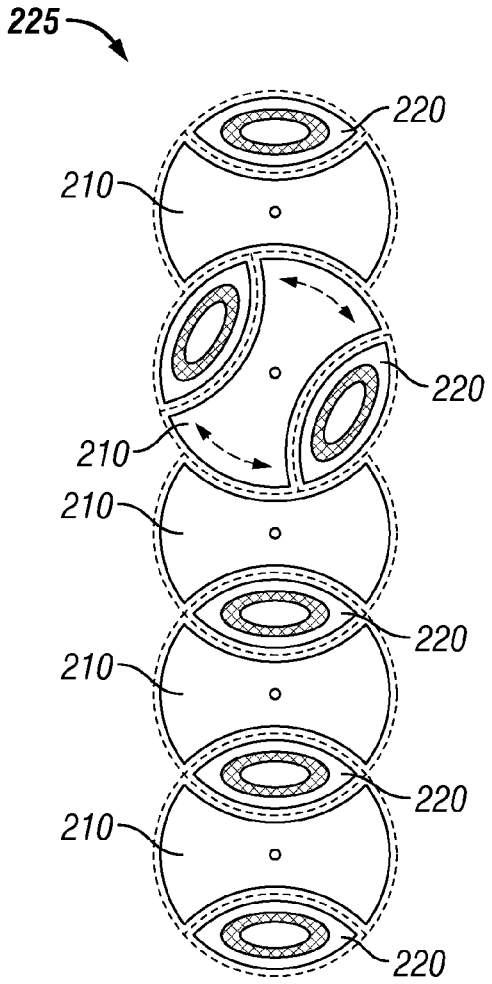
FIG. 4 is an illustration of a gear set in accordance with another embodiment of a hair-braiding device in accordance with the present disclosure.
Figure 4B:
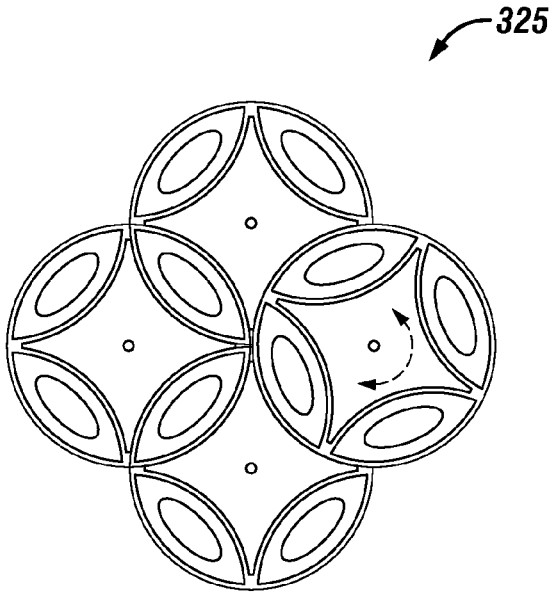
Figure 4C:
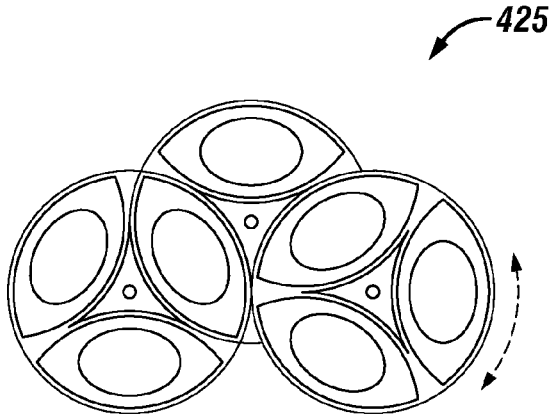

The present disclosure further includes alternative embodiments comprising expanded gear sets with the ability to handle more than four strands of hair or filaments. One alternative embodiment is shown in FIG. 4A, wherein the gear set 225 comprises five sector gears 210 and six elliptical gears 220, in a linear arrangement. Similarly, other linear arrangements may be devised comprising "n" sector gears and "n+1" elliptical gears. FIG. 4B illustrates another embodiment of the present disclosure, wherein gear set 325 has 12 elliptical gears arranged around four sector gears. This embodiment is therefore able to weave up to 12 strands of hair or filament at one time. FIG. 4C illustrates another embodiment comprising a gear set 425 arranged in a triangular formation, having seven elliptical gears and three sector gears. Further embodiments with numerous potential arrangements are also contemplated by the present disclosure, as may be apparent to one having ordinary skill in the art.

As discussed above, the elliptical gears 120 comprise a hollow center for carrying strands of a flexible material. In some embodiments, the hair-braiding device of the present disclosure comprises a plurality of sleeves 130, which fit into the hollow center of the corresponding elliptical gears 120. The sleeves 130 are formed from a flexible material that may be removed from the elliptical gears and replaced. The sleeves 130 may be used to assist in bundling the flexible material into strands (including bundles of individual strands). The sleeves 130 may also be configured to preserve tension on the strands without requiring additional work from a user. This may be accomplished by selecting a tactile material for the sleeves 130.

Figure 5A:
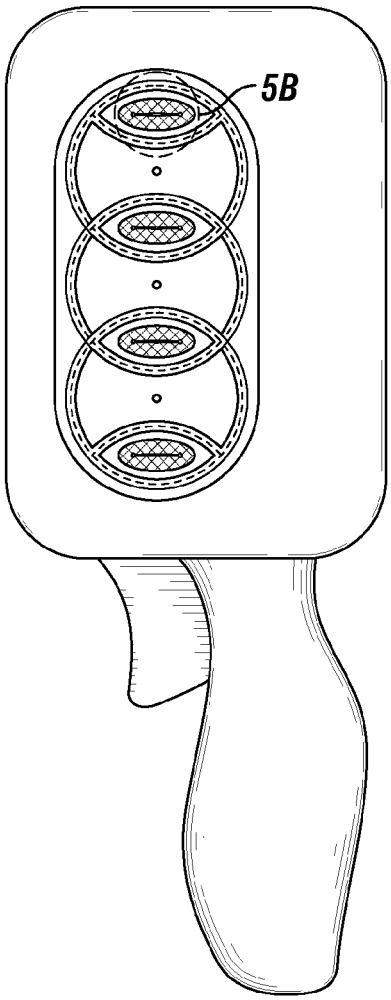
FIG. 5 is an illustration of a sleeve according to one embodiment of the hair-braiding device of the present disclosure.
Figure 5B:
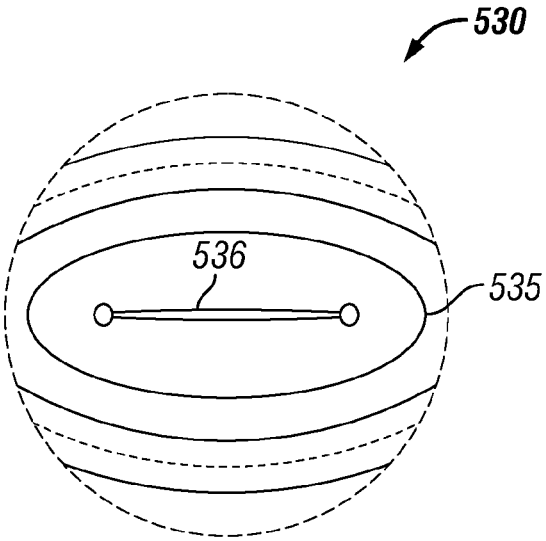

FIG. 5 illustrates another embodiment of the present disclosure, wherein the sleeves 530 may be constructed with a surface 535 that substantially fills the hollow space within the elliptical gears. In the embodiment shown in FIG. 5, the sleeve 530 further includes a slot 536, through which the strands may be inserted. The sleeve 530 should be formed of a flexible material, wherein slot 536 exhibits some elastic properties, thereby accommodating various sizes of strands. The elastic properties of sleeve 530 also help to create tension on the strands when in use.

The present disclosure may be implemented using a variety of mechanisms to hold the strands in place while operating the device 100. In a further embodiment, for example, the sleeves 130 may be replaced by individual clasps that hold the individual strands in the hollow center portion of the elliptical gears 120. Alternatively, the clasps may be provided at the free end of the strands.

Referring again to FIG. 2C, the controller 170 sends signals to each of the motors 140, which turn the sector gears 110, thereby rearranging the elliptical gears 120 and the respective strands which pass through the elliptical gears, resulting in the formation of the desired braid. In some embodiments the motors 140 can be controlled to operate in a number of different sequences, each one forming a unique braid. Further, the operation of the motors may be changed from one pattern to another after a specified number of turns, thereby forming a series of alternating braid patterns in the strands of hair or filaments. The hair-braiding device 100 may also comprise a number of sensors 145, which allow the controller to sense the rotation of the gears. In some embodiments, the controller comprises a processor.

The various braiding patterns discussed above may be stored, for example, as a pattern module comprising a set of instructions. For example, the memory unit 180 may be provided with free space thereon, whereby additional or new patterns may be loaded onto the memory unit 180 and stored therein. The controller 170 may recall any of the stored braiding patterns via user input. Referring again to FIG. 2B, the user input may be provided via the user interface 150. The user interface 150 may be a simple switch or dial or may be provided as a graphical user interface (GUI), as shown, wherein the GUI comprises a touchscreen. In alternative embodiments, the functions of the user interface may be fulfilled using an external computing device, such as a smart phone, or a computer.

In some embodiments, the pattern modules may be stored in the memory unit using a number of different methods. For example, the user may provide new patterns for the hair-braiding device 100 by uploading them into the device or by using the GUI. Patterns may be uploaded, for example, using connector 185, which may be configured to receive a communications cable, such as a USB interface. Alternatively, the patterns may be uploaded wirelessly, using a suitable communication protocol, such as Bluetooth, Wi-Fi, infrared transmission, or some other type of communication.

The actuator 160 allows the user to control the starting and stopping of the motor without disrupting the overall set of instructions being executed by the controller 170. The actuator 160, which may alternatively comprise a trigger, button, lever, or switch, allows the user to have direct control over the device. The actuator 160 may further include a spring. In some embodiments, the actuator 160 comprises multiple settings to control the speed of the gears. This may be controlled, for example, based on the amount of force placed on the actuator 160. Also, the actuator 160 may comprise a sliding selector, which may be moved laterally to control the speed of the output.

The hair-braiding device 100 further comprises a power source 190, which provides electrical power to the various parts of the device. The power source may comprise a battery, an AC connection, and/or the connector 185. The power source may comprise a rechargeable battery in connection with an AC connection and/or power from the connector 185. In FIG. 2C, the embodiment is shown with the power source 190 residing inside the handle 102. In other embodiments, the power source 190 may be located within the housing 101 or external to the device 100.

Figure 6A:
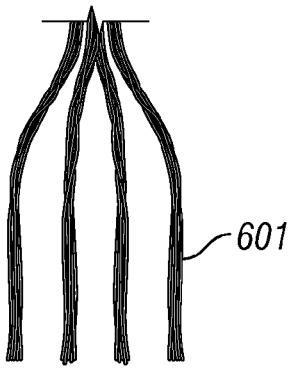
FIGS. 6A-6E are illustrations of various steps of a method for forming a four-strand braid according to the present disclosure.

In operation, the hair-braiding device 100 of the present disclosure may be used as part of a method for intertwining multiple strands of a flexible material in various braid patterns. In one embodiment, shown in FIG. 6A, the method comprises separating four strands 601 (wherein a strand may be a bundle of individual hairs, filaments, or other flexible material). This flexible material may include flexible metallic elements, fibrous elements, human or animal hair (such as a horse's tail), animal skins, textiles, or any other flexible material that the user may desire to weave. Alternatively, where the strands comprise a bundle of flexible material, the bundle may be temporarily held together with a rubber band or a small strip of paper, as is commonly known in the art.

Figure 6B:
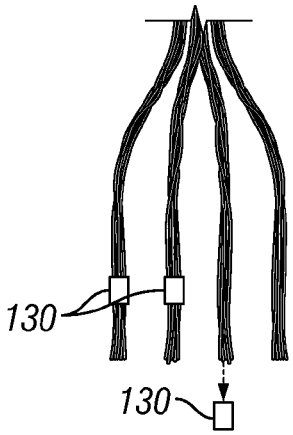
Figure 6C:
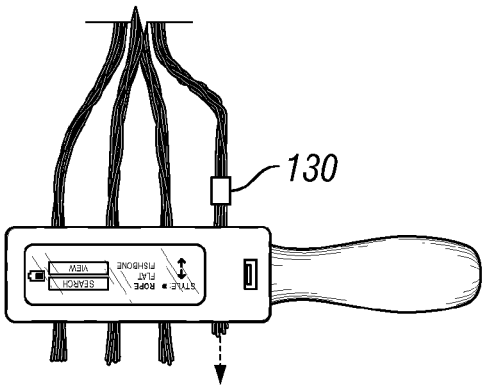

In FIG. 6B, the strands 601 are shown being inserted into the sleeves 130. Referring to FIG. 6C, once each of the strands are placed into the sleeves, the sleeves 130 are placed in the hair-braiding device 100 at the center of the elliptical gears 120 (not shown). Alternatively, the strands may be placed directly into the elliptical gears without the sleeves 130 or the sleeves may be left in the elliptical gears 120 while the strands are inserted.

Figure 6D:
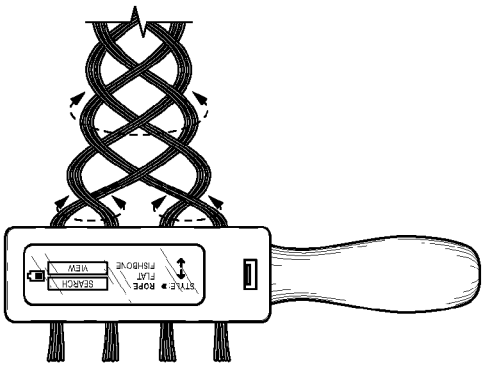

Next, the user selects the desired pattern and begins operating the hair-braiding device 100 using actuator 160. FIG. 6D illustrates the weaving action of the hair-braiding device 100 when in use. The resulting braid will have a more aesthetic appearance where the correct amount of tension is placed on each strand 601. In some embodiments, this tension is provided by the sleeves 130, as discussed above. Finally, once the weaving action is complete, the hair-braiding device 100, including the sleeves 130, is removed from the ends of the strands.

Figure 6E:
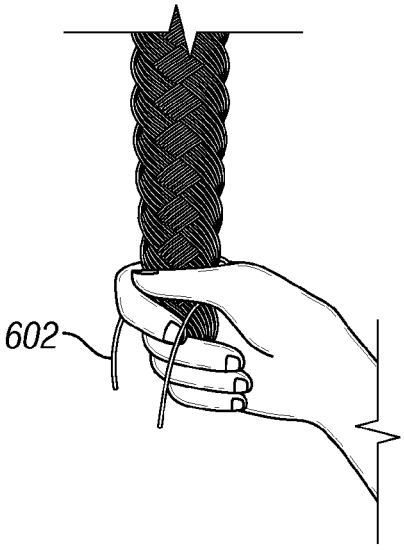

Referring to FIG. 6E, the resulting weave or braid is then secured. In some embodiments, the woven strands may be secured by using a tie 602, which may be a ribbon or an elastic band. Alternatively, the woven strands may be secured by singeing, by use of an adhesive, or by another known method.

Figure 7:
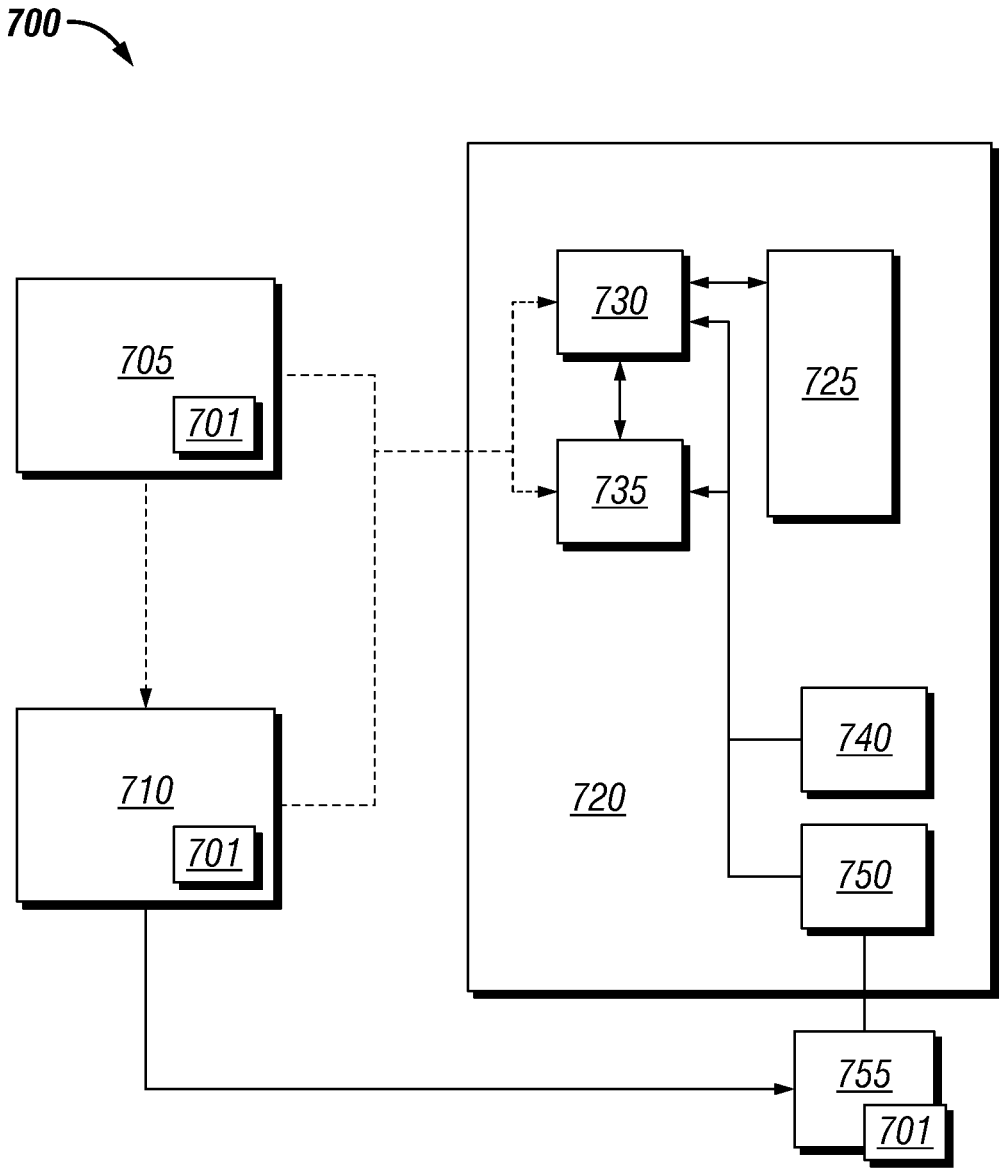
FIG. 7 is a schematic of one embodiment of a system for selecting a hair-braiding style according to another aspect of the present disclosure.

Referring to FIG. 7, another aspect of the present disclosure provides a method 700 for selecting a desired pattern module 701 for use with a hair-braiding device in accordance with the present disclosure. As with the various embodiments discussed above, the hair-braiding device 100 may be employed in connection with many other flexible materials in addition to hair. A pattern 701 may be located on an internet server 705, on a computing device 710, (such as a smart phone, tablet, or computer), or on a readable media device 755, (such as, for example, a flash drive, a memory card, a cartridge, or some other proprietary or commonly used design). The pattern module 701 may be downloaded from the internet server 705 to the computing device 710, or from the computing device 710 to the readable media device 755. The pattern module 701 may be stored in the memory unit 735 of the hand-held device 720, or it may be loaded directly into the controller 730. The storing or loading of the pattern module 701 may be accomplished using wireless communication, as described above, or through a connector, such as cable connector 740 or readable media connector 750. Where a plurality of pattern modules 701 are stored on the memory unit 735, the desired pattern module 701 may be selected using the user interface 725. Alternatively, the function of the user interface 725 may be performed using the computing device 710.

It should be emphasized that the above-described embodiments of the present device and method are merely possible examples of implementations and merely set forth for a clear understanding of the principles of the disclosure. Many different embodiments of the disclosure described herein may be designed and/or fabricated without departing from the spirit and scope of the disclosure. All these and other such modifications and variations are intended to be included herein within the scope of this disclosure and protected by the following claims. Therefore the scope of the disclosure is not intended to be limited except as indicated in the appended claims.

The invention claimed is:

1. A device for intertwining strands of hair in a desired pattern, comprising:

a housing, suitable for holding in the hand of a user, having a top opening and a bottom opening therein, the top and bottom openings being substantially aligned;

a plurality of gears, forming a gear set, the gear set being at least partially accessible through the top opening in the housing, the gear set comprising at least three sector gears, at least two of which are non-adjacent, disposed in a group of multiple intersecting circles defining an area of intersection between adjacent circles, and a plurality of elliptical gears, each elliptical gear having a hollow center portion therein, the hollow center portion being substantially aligned with at least a portion of the top and bottom openings and adapted for through passage of a strand of hair, each elliptical gear having a shape of and occupying the area of intersection of adjacent sector gears, positioning of the elliptical gears within the area of intersection of adjacent sector gears preventing the adjacent sector gears from simultaneous rotation, only non-adjacent sector gears of the group being simultaneously rotatable;

at least one motor for selectively turning any one or more of the plurality of sector gears; and a controller, having a processor, configured to execute a set of instructions from any of a plurality of pattern modules by controlling the at least one motor to selectively rotate one or more of the plurality of sector gears and move the adjacent elliptical gears in an intertwining motion according to the set of instructions of one of the pattern modules, the pattern modules being stored in a memory unit associated with the controller.

2. The device of claim 1, further comprising a connector, coupled to the processor, configured to connect to a communications cable.

3. The device of claim 1, further comprising a connector, coupled to the processor, configured to receive information from a readable media device.

4. The device of claim 1, wherein the gear set is at least partially accessible through the bottom opening.

5. The device of claim 1, wherein the bottom opening in the housing and the top opening in the housing are substantially similar in shape.

6. The device of claim 1, wherein the gear set further comprises a plurality of sector gears, each of the plurality of elliptical gears being arranged to rotate with any one of the plurality of sector gears.

7. The device of claim 6, wherein each of the plurality of sector gears is arranged to rotate about one of a plurality of pivots.

8. The device of claim 6, wherein the at least one motor is of a quantity that is equal to a quantity of the plurality of sector gears.

9. The device of claim 6, further comprising a plurality of sensors, wherein each of the plurality of sensors is configured to monitor rotational displacement of each of the plurality of sector gears, and wherein the controller is configured to receive data from the sensors.

10. The device of claim 1, further comprising a user interface, operatively coupled with the processor, configured to enable a user to select a pattern module.

11. The device of claim 1, further comprising an actuator.

12. The device of claim 6, wherein each of the plurality of elliptical gears and at least a portion of each of the plurality of sector gears comprise gear teeth on a periphery thereof.

13. The device of claim 12, wherein the at least one motor further comprises at least one worm drive.

14. The device of claim 1, further comprising a removable sleeve, disposed within the hollow center portion of each of the plurality of elliptical gears.

15. A device for intertwining strands of hair in a desired pattern, comprising:

a housing, suitable for holding in the hand of a user, having substantially aligned top and bottom openings;

a gear set, at least partially accessible through the top opening, including at least three sector gears, disposed in a group defining multiple intersecting circles, including at least two non-adjacent sector gears, each sector gear arranged to rotate about a fixed pivot point; and at least four elliptical gears, each of the elliptical gears having a shape of and occupying an area of intersection of any two adjacent sector gears, being arranged to rotate with any one of the plurality of sector gears, and having a hollow center portion that is substantially aligned with the top and bottom openings and adapted for through passage of a strand of hair, positioning of the elliptical gears within the area of intersection of adjacent sector gears preventing the adjacent sector gears from simultaneous rotation, only non-adjacent sector gears of the group being simultaneously rotatable;

a plurality of independently operable motors, each motor associated with and engaged to selectively rotate a discrete one of the plurality of sector gears; and a controller, including a processor, configured to independently selectively operate any one of the plurality of motors in accordance with a pattern module, to selectively rotate one or more of the plurality of sector gears and move the elliptical gears in an intertwining motion.

16. The device of claim 15, further comprising a connector, coupled to the controller, configured to receive data from one of a communications cable and a readable media device.

17. The device of claim 15, further comprising a memory unit, associated with the controller, configured to store the pattern module as a set of instructions for operating the plurality of motors.

18. The device of claim 17, wherein the memory unit is configured to store a plurality of pattern modules.

19. The device of claim 18, further comprising a user interface, operatively coupled with the controller, configured to enable a user to select a pattern module from the plurality of pattern modules stored in the memory unit.

20. The device of claim 19, wherein the user interface comprises a graphical user interface.

21. The device of claim 15, further comprising a plurality of sensors, coupled to the controller, each sensor configured to monitor rotational displacement of a discrete one of the plurality of sector gears, the controller being configured to receive data from the sensors.

22. The device of claim 15, wherein each of the plurality of elliptical gears and at least a portion of each of the plurality of sector gears comprise gear teeth on a periphery thereof, and each of the plurality of motors comprises a worm drive, engageable with the gear teeth on the periphery of an associated sector gear and its co-rotating elliptical gears.

23. The device of claim 15, further comprising a removable sleeve, disposed within the hollow center portion of each of the plurality of elliptical gears.

* * * * *